US006040658A

United States Patent [19]

Bashlov et al.

[11] Patent Number: 6,040,658

[45] Date of Patent: Mar. 21, 2000

[54] DISCHARGE LAMP WITH HO RADICALS AS RADIATING ADDITIVES

[75] Inventors: Nikolai L. Bashlov; Alexandr Y. Vul; Sergei V. Kidalov; Sergei Kozyrev; Vyacheslav M. Milenin; Nikolai A. Timofeev, all of St. Petersburg, Russian Federation

[73] Assignee: Aktsionernoe Obschestvo Zakkytogo Tipa Nauchno-Tekhniches Koe Agentstvo "Intellekt"

[21] Appl. No.: 09/011,150

[22] PCT Filed: Jul. 26, 1996

[86] PCT No.: PCT/RU96/00203

§ 371 Date: Apr. 20, 1998

§ 102(e) Date: Apr. 20, 1998

[87] PCT Pub. No.: WO97/05646

PCT Pub. Date: Feb. 13, 1997

[30] Foreign Application Priority Data

Aug. 1, 1995 [RU] Russian Federation ..... 95113226

[51] Int. Cl.[7] ..... H01J 17/20; H01J 61/12

[52] U.S. Cl. ..... 313/637

[58] Field of Search ..... 313/637, 643, 313/570, 572

[56] References Cited

U.S. PATENT DOCUMENTS

| | | | |
|---|---|---|---|
| 3,611,186 | 10/1971 | Witteman | 313/643 |
| 4,929,868 | 5/1990 | Bouchard | 313/619 |
| 5,382,873 | 1/1995 | Scholl et al. | 313/570 |
| 5,404,076 | 4/1995 | Dolan et al. | 313/572 |

*Primary Examiner*—Ashok Patel
*Attorney, Agent, or Firm*—F. Brice Faller

[57] ABSTRACT

The method of producing optical radiation and a discharge lamp for that purpose pertain to electrical technology, specifically to methods of producing radiation in the visible spectrum resulting from electrical discharge in gas, and to low-pressure discharge lighting lamps of various types. The proposed method of producing optical radiation, and the associated discharge lamp, extend the available range of environmentally clean lighting systems. The method involves creating a gas discharge in an inert gas atmosphere with a radiating additive in an optically transparent tube. A novelty of the method lies in the use as a radiating additive of the HO radical. The discharge lamp comprises an optically transparent tube (1) filled with an inert gas and a radiating additive. Also novel is the use as a radiating additive of an HO source obtainable from water or group II metal alkalis.

6 Claims, 7 Drawing Sheets

DISCHARGE LAMP WITH HO RADICALS AS RADIATING ADDITIVES

TECHNICAL FIELD

The present group of inventions relates to the electrical engineering industry, more specifically to methods of generating radiation in the visible spectrum as a result of an electrical discharge in gas, and also to low-pressure discharge illumination lamps of various types: argon, xenon, krypton, sodium, mercury, mercury-luminescent et alia.

KNOWN ART

A method is known of producing optical radiation, comprising the creating of a gas discharge in a mixture of sodium vapours at a pressure of 0.1–1.0 Pa with inert gases at a pressure of 100–1500 Pa in a tube of optically transparent material (cf. G. N. Rokhlin "Discharge light sources", Moscow, Energoatomizdat, 1991, pp. 451–457).

Said known method of producing optical radiation is based on the fluorescent radiation of sodium vapours (589.0 and 589.6 nm), i.e. almost monochromatic yellow light that cannot be transformed by means of phosphors, as a result of which said method is unsuitable for general lighting. In order to accomplish said method, the use of a chemically aggressive substance—sodium—is required.

A gas discharge lamp is known comprising a glass tube into which two electrodes are hermetically sealed. Said tube is filled with neon plus 0.5–1.0% argon at a pressure of up to 600 Pa, said sodium is likewise introduced into the tube. The tube is externally provided with small convexities (internal dimples) for condensation of the sodium and is fitted inside an evacuated outer glass envelope whose inner surface is coated with a thin indium oxide film (cf. G. N. Rokhlin "Discharge light sources", Moscow, Energoatomizdat, 1991, pp. 451–457).

The known discharge lamp allows only a monochromatic yellow light to be obtained that cannot be transformed by means of phosphors, and moreover contains sodium, a chemically aggressive substance.

A method is known of producing optical radiation, comprising the creating in a tube of optically transparent material of a gas discharge of varying lengthwise cross-section in an inert gas and mercury vapour atmosphere. The magnitude of the current and pressure in the discharge space is selected so as to ensure the periodic interruption of discharge (see RF patent specification No. 1814741, c1. H01J 61/72, pub. 07.05.93).

Said known method allows radiation to be generated in the UV, visible and near-IR regions of the spectrum with high efficiency and brilliance. However, the use of mercury vapour renders it environmentally hazardous.

A mercury gas discharge lamp is known for lighting cucumber greenhouses comprising an optically transparent discharge chamber with electrodes sealed therein and filled with inert gas and mercury in such quantity as to maintain the operating pressure during discharge and with radiating additives in the form of lithium, sodium and indium iodides in the following quantities (% wt.): lithium iodide 8–18; sodium iodide 70–88; indium iodide 4–12 (cf. RF patent specification No. 1816330 c1. H01J 61/18, publ. 15.05.93).

The presence of mercury as a working substance is undesirable from the viewpoint of the environmental friendliness of the fabrication, operation and subsequent disposal of such lamps.

The method that is closest, in terms of the totality of substantive features, to the claimed method is a prototype method of producing optical radiation comprising the creating in a tube of optically transparent material of a gas discharge in an atmosphere of inert gas, mercury vapour and radiating additives in the form of metal halides at an inert gas pressure of 2660–39900 Pa (cf. USSR Inventor's Certificate No. 1833927 c1. H01J 61/18, publ. 15.08.93).

The known method, by virtue of the introduction of radiating additives of various metals, allows high-power lamps to be produced that embrace the most varied radiation spectrum at significantly higher efficiencies as compared with mercury-only lamps.

A drawback of said prototype method is that mercury has to be employed which is extremely undesirable from the viewpoint of environmental friendliness.

The lamp that is closest, in terms of the totality of substantive features, to the claimed discharge lamp embodying the method is a prototype discharge lamp comprising an discharge chamber of optically transparent material with sealed-in electrodes and filled with inert gas, mercury and additives supplying halides of radiation metals to the discharge chamber, for which purpose additives supplying silver, copper and zinc halides to the discharge chamber are used, said constitutents being employed in the following quantities ($\mu$mol/cm$^3$):

| | |
|---|---|
| Mercury | 1.5–45.0 |

Additives supplying to the discharge chamber halides of:

| | |
|---|---|
| Silver | 0.5–12.0 |
| Copper | 0.3–9.0 |
| Zinc | 0.2–8.0 |

while the inert gas pressure measure 1.33–39.9 kPa (cf. RF patent specification No. 17263 c1. H01J 61/18, pub. 30.07.94).

Notwithstanding all the advantages of the known prototype discharge lamp it is not environmentally friendly on account of the presence of mercury during the fabrication, operation and subsequent disposal thereof.

DISCLOSURE OF INVENTIONS

The aim of the present group of inventions was to broaden the available range of means of producing optical radiation by creating an environmentally clean method of producing optical radiation and a discharge lamp for that purpose.

The stated aim is achieved by using, in the method of producing optical radiation comprising the creating in a tube of optically transparent material of a gas discharge in an atmosphere of inert gas with a radiating additive, the HO radical (hydroxyl group) as radiating additive. The hydroxyl radical HO may be formed by various means: by feeding water vapour into the discharge or by heating group II metal alkalis situated in the tube wherein discharge is accomplished.

The stated aim is likewise achieved by introducing an HO radical source, in a discharge lamp embodying the method of producing optical radiation and comprising a tube of optically transparent material filled with inert gas and radiating additive, in order to form said radiating additive. For lighting purposes, the HO radical source if introduced in a quantity of $10^{-11}$ –$10^{-7}$ mol/cm$^3$. As the cheapest and simpliest HO radical source, water of some substance containing the hydroxyl group may be used. Group II metal alkalis, e.g. $Ca(OH)_2$ or $Mg(OH)_2$, which when heated disassociate into highly stable oxides and water, may be expediently used as such a source.

The claimed group of inventions is based on the phenomenon surprisingly discovered by the inventors whereby the radiation spectrum of gas discharge in an inert gas undergoes a qualitative change on introduction of the HO radical therein. Introduction of the hydroxy HO fundamentally changes the properties of discharge, particularly its radiation characteristics. In the absence of the hydroxyl, the characteristics of gas discharge are determined by the inert gas atoms and ions. During glow discharge, maximum radiation of the energized inert gas atoms coincides with fluorescent radiation in the vacuum UV region. On introduction of the HO radical, discharge radiation changes into the radiation of HO molecules alone to all intents and purposes, whose fluorescent radiation forms a 306.4 nm band lying in the near-UV region of the spectrum. HO radical radiation may be used direct, e.g. in technological processes or to irradiate vegetation and living organisms (as such radiation lies approximately in the middle of the 280–350 nm UV radiation region that has the most beneficial effect on vegetation and living organisms including man), and may also be transformed very efficiently, by means of the appropriate phosphor applied on the wall of the outer envelope enclosing the tube in which gas discharge is accomplished (the so-called discharge chamber), into the visible region of the spectrum. Hydroxyl molecules are readily obtained during glow discharge, e.g. from water molecules. On interruption of discharge from the hydroxyl radicals, water molecules are formed anew. This makes the use of hydroxyl absolutely harmless. The potentials required for ionization and for energizing the HO radicals (12.9 V and 4.0 V respectively) are substantially lower than the corresponding potentials for the atoms of the inert gases argon, helium, neon and krypton, which allows discharge conditions to be created in which the inert gas becomes a buffer gas, with a small addition of the HO radical acting as the active element of gas discharge. The fluorescent nature of the radiation of the energized HO radical ensures that electrical energy is transformed into electromagnetic radiation energy in the UV region of the spectrum highly efficiently.

BRIEF DESCRIPTION OF DRAWINGS

The claimed method of producing optical radiation and the claimed discharge lamp are illustrated in the drawings, wherein:

In FIGS. 1–3, the horizontal axis represents radiation wavelengths in nm and the vertical axis the radiation intensity in relative units.

As can be seen in FIGS. 26 and 34, introduction of the HO radical into the discharge causes a fundamental change in the spectrum: the inert gas lines are virtually absent and all the radiation is found to be concentrated in the hydroxyl's 306.4 nm band. The type of inert gas does not basically change the nature of the spectrum: analogous results were obtained when neon and krypton were introduced into the lamp as insert gas.

Figure 4:
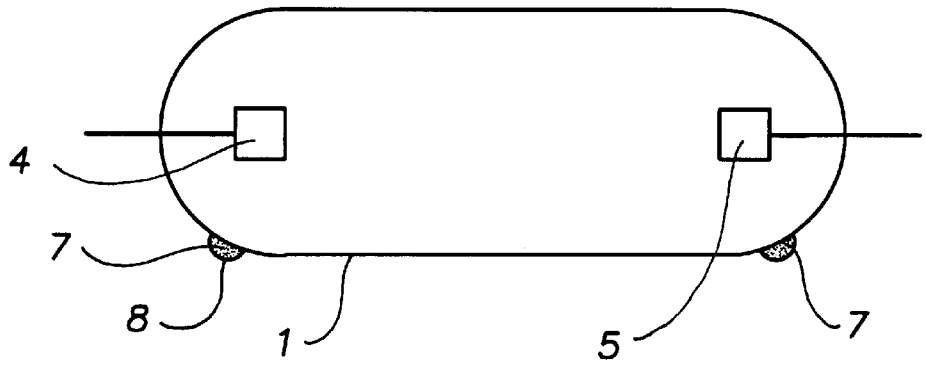
FIG. 4 shows a cross-section of the UV radiation discharge lamp.
Figure 5:
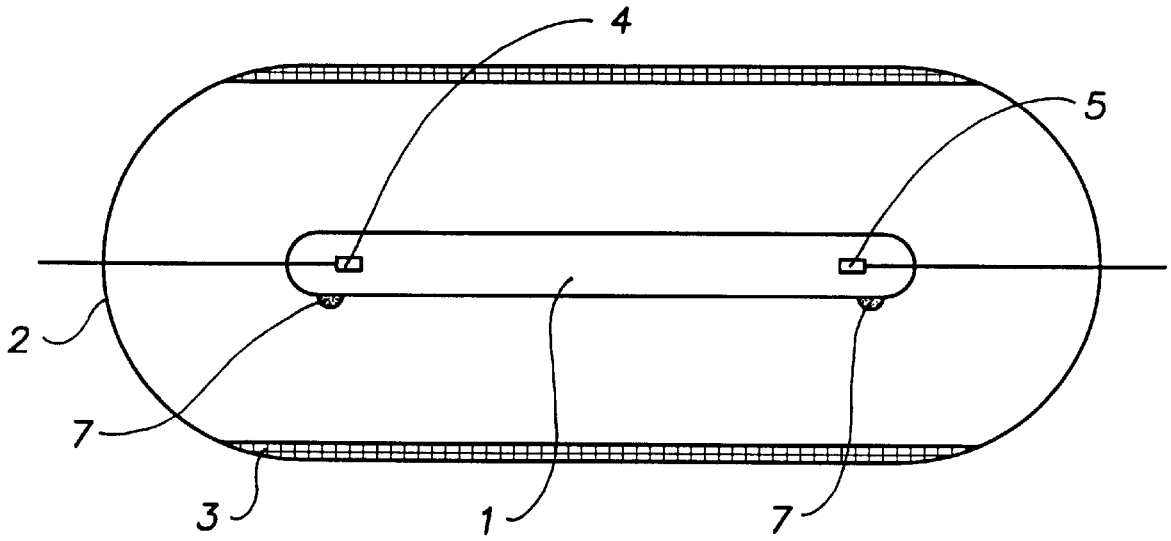
FIG. 5 shows a cross-section of the discharge lamp with phosphor.

As seen in FIG. 4, the discharge lamp comprises a hermetically sealed tube 1 (discharge chamber), made of optically transparent material e.g. quartz, ceramic or UV-transmitting glass with sealed-in electrodes 4, 5 and appendages 8 for an HO radical source 7. In the embodiment with a phosphor coating (FIG. 5), the hermetically sealed tube 1 is situated in an external evacuated (to reduce heat exchange) envelope 2 on whose inner surface a phosphor coating 3 has been applied in order to transform the spectrum of the radiation being generated from the UV region to the visible region. The hermetically sealed tube 1 is filled with inert gas (e.g. argon, helium, xenon, krypton or mixtures thereof).

Figure 6:
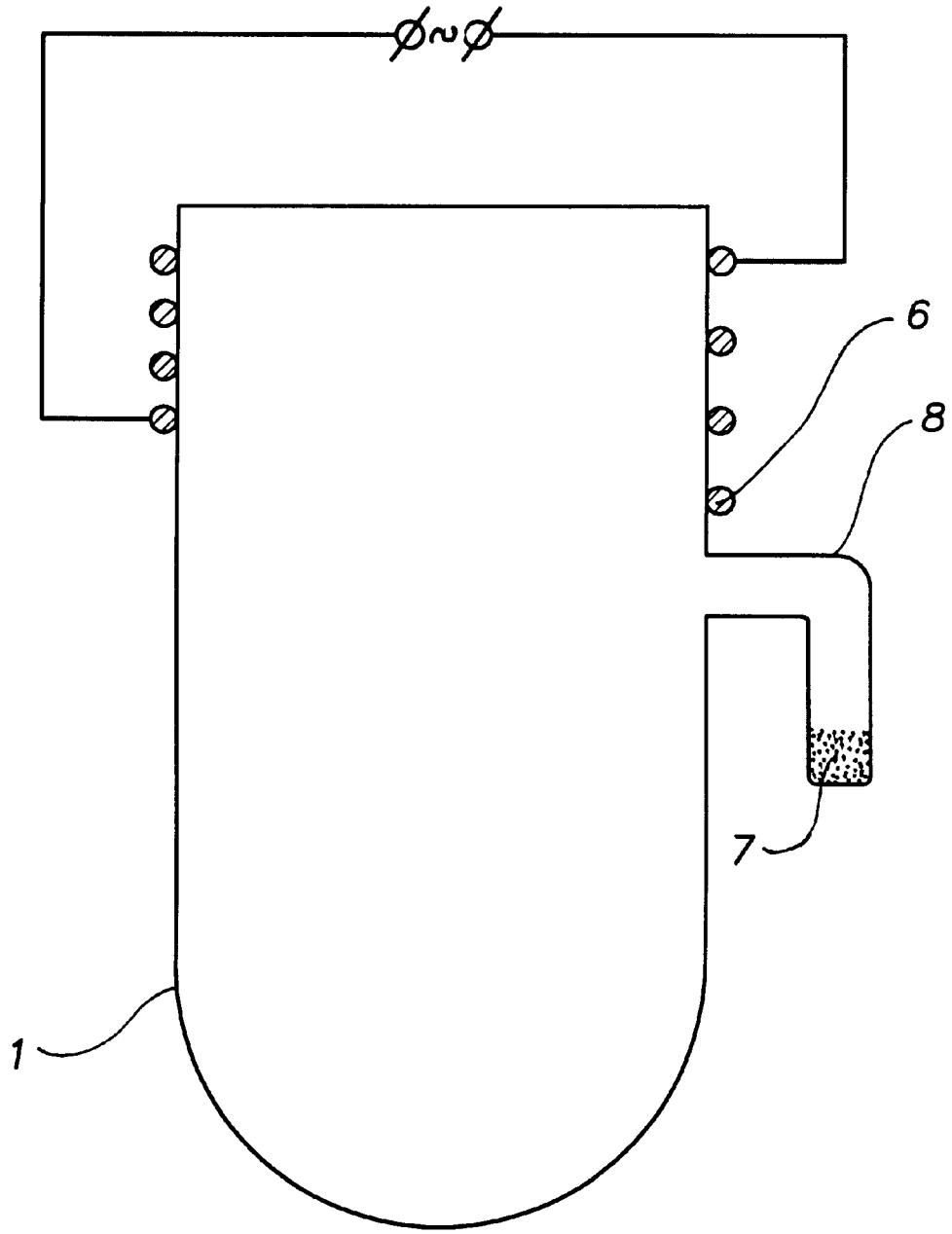
FIG. 6 shows a cross-section of an embodiment of the discharge lamp without electrodes.

The tube 1 may be furnished with operating electrodes 4 and 5 (e.g. tungsten electrodes), whereas in the alternative embodiment without electrodes (FIG. 6) such electrodes are absent and in order to activate discharge use is made of a high-frequency coil 6 connected to a high-frequency generator (not shown in diagram). The HO radical source 7, e.g. $Ca(OH)_2$, may be situated behind the electrodes 4 and 5, in the appendages 8 of tube 1 (FIGS. 4 and 5); or outside the coil 6 (FIG. 6).

EMBODIMENTS OF THE INVENTIONS

The claimed method is accomplished with the aid of the discharge lamp in the following manner. As HO radical source, water is placed in the lamp. The voltage required to activate discharge in tube 1 is applied to electrodes 4 and 5 (to coil 6 in the non-electrode embodiment of the lamp). Between electrodes 4 and 5 an electrical discharge is produced while envelope 1 is heated. Water vapour enters the electrical discharge zone to form HO radicals. Optical radiation in the UV region is thereby produced. If optical radiation of some other spectral composition is required, an appropriate phosphor coating 3 is applied to the inner surface of envelope 2 to transform the UV radiation from tube 1 into the visible region of the spectrum.

EXAMPLE 1

Figure 1:
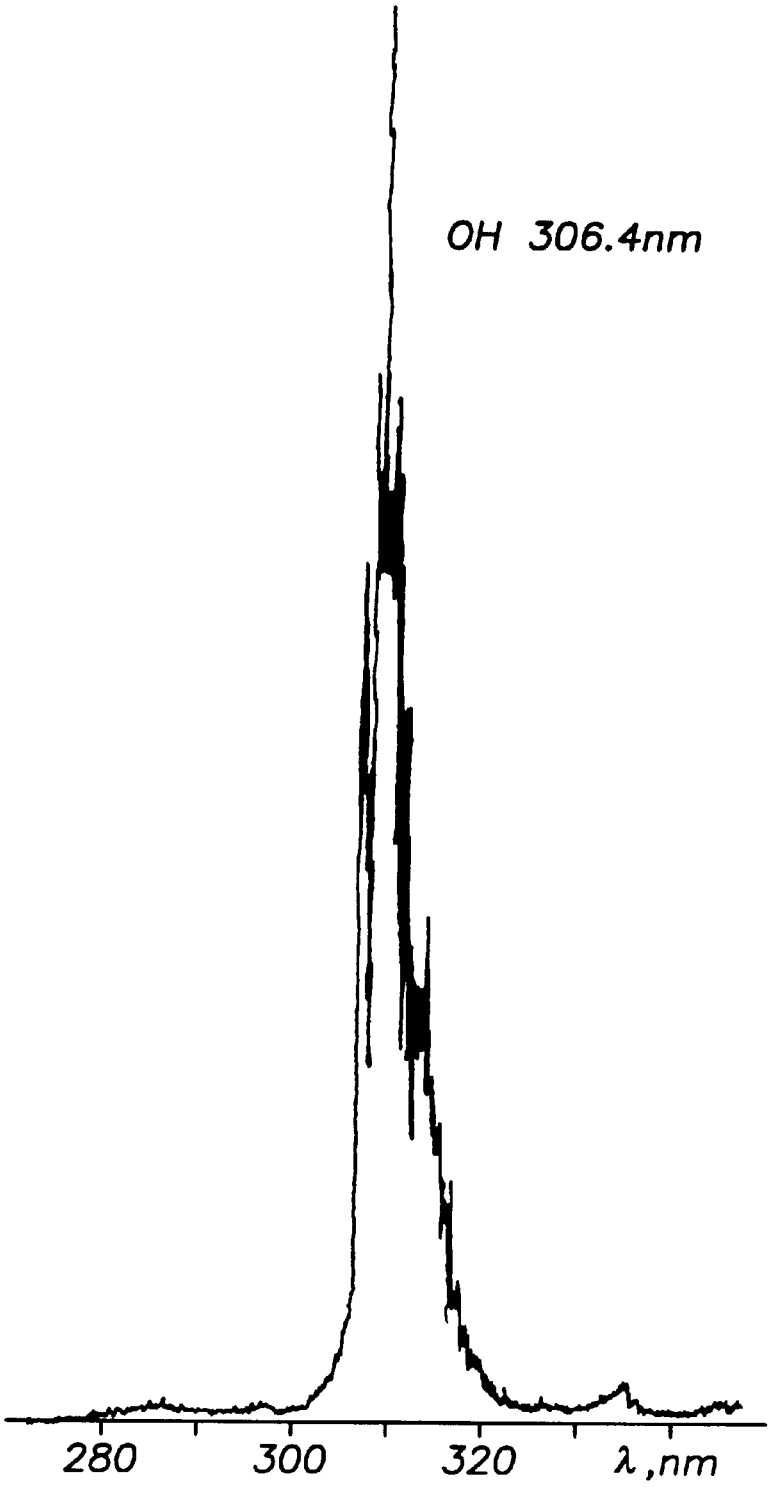
FIG. 1 shows the HO radical's radiation spectrum.
Figure 2A:
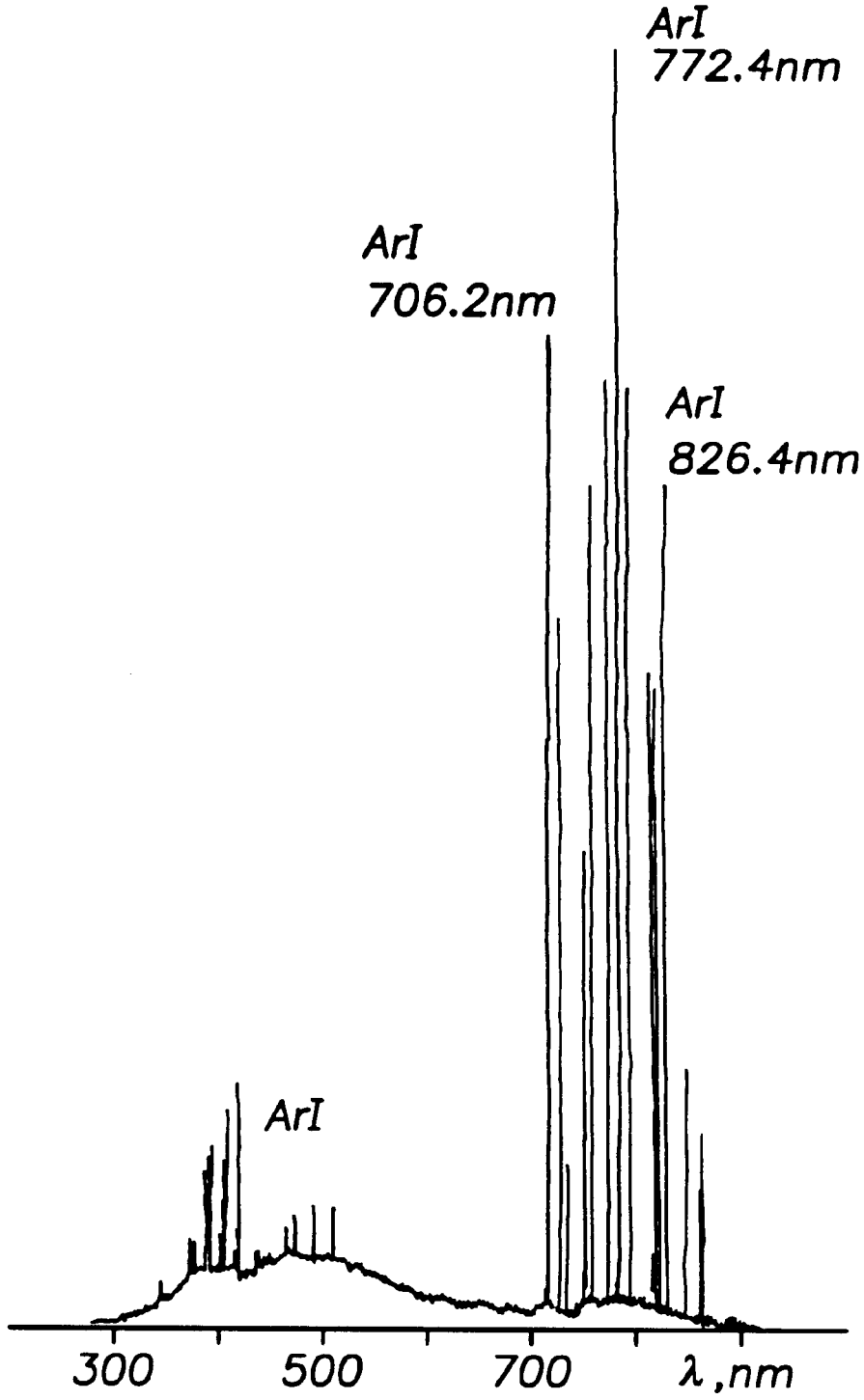
FIG. 2 shows the discharge lamp's radiation spectrum; a—lamp is filled with argon (at a pressure of 3857 Pa and discharge current 30 mA); b—lamp is filled with argon (at a pressure of 3857 Pa and discharge current 30 mA); with addition of the HO radical obtained during discharge from water.
Figure 2B:
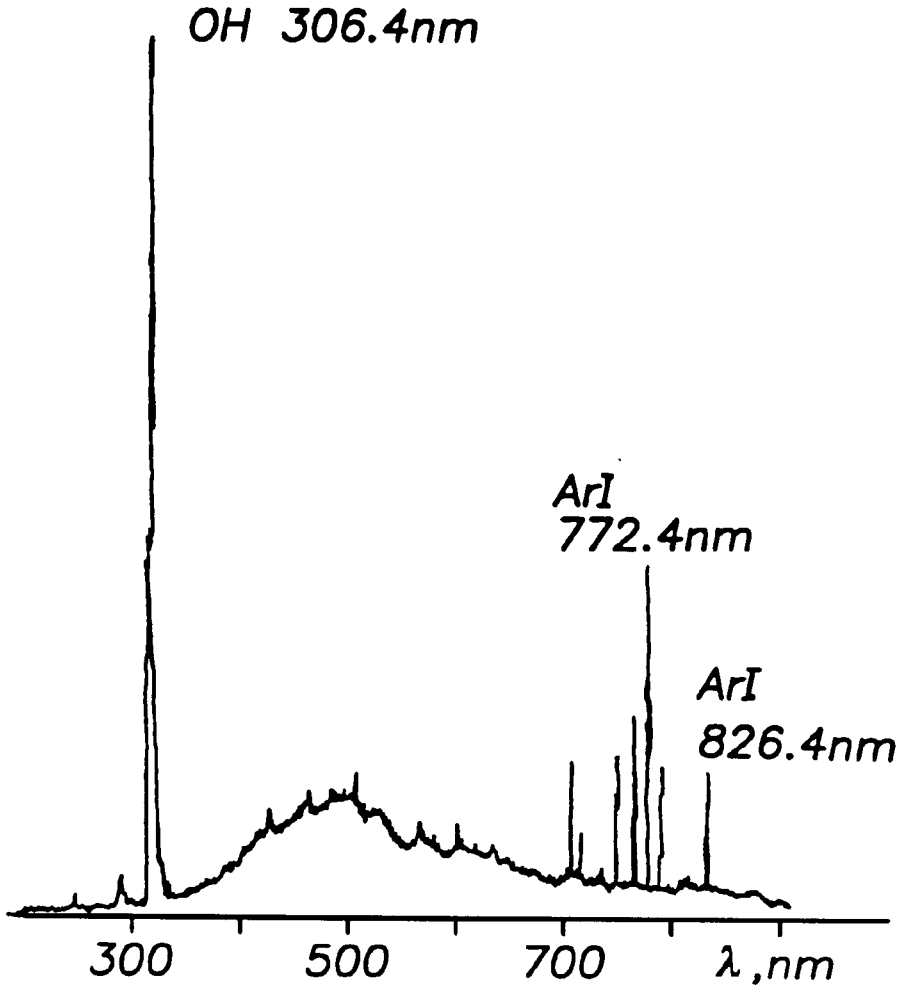

A discharge lamp was fabricated in the form of a quartz cylindrical tube, 20 mm in diameter, at the extremities of which two tungsten electrodes were sealed in. In the middle of the tube an appendage was made in which calcium alkali was placed. The tube was connected up to a vacuum system. Tungsten coils were wound onto the tube and appendage to heat the discharge chamber, with the tube wall temperature and appendage temperature being varied independently of one another. The temperature was measured by means of thermocouples situated on the tube wall and the surface of the appendage. The tube was first evacuated by means of the vacuum system and then filled with argon up to a pressure of 3857 Pa. A direct-current voltage of 600 V was applied to the electrodes sufficient to spark over the distance between the electrodes, whereupon the voltage was reduced to 300 V. The radiation emitted by the axial discharge region was focused on the inlet aperture of a spectrum instrument whose outlet was connected via a photoelectron multiplier and amplifier to a recording instrument to record the discharge radiation spectrum in the 200–800 nm wavelength range. The radiation spectrum recorded by the instrument is shown in FIG. 2(*a*). It represents the radiation of the argon atoms filling the lamp tube. Then the HO radical source ($Ca(OH)_2$) in the lamp's appendage was heated until it disassociated into water and calcium oxide. The water vapour entering the discharge region formed HO radicals. The discharge lamp's optical radiation in the presence of HO radicals was recorded and the radiation spectrum is shown in FIG. 2(*b*). The argon lines were "suppressed" and a new line appeared in the UV region of the spectrum (306.4 nm).

EXAMPLE 2

A non-electrode discharge lamp was fabricated from a quartz tube, 10 mm in diameter, which was connected up to a vacuum system. A high-frequency circuit was wound onto part of the tube's surface and the central part of the tube was provided with an appendage in which water was placed. Tungsten heating coils were wound onto the tube walls and the appendage to allow the tube wall temperature and appendage temperature to be varied independently of one another. The discharge lamp was first evacuated (without water in the lamp's appendage) by means of the vacuum system and then filled with argon up to a pressure of 3857 Pa. Discharge in the lamp was activated by means of a high-frequency electromagnetic field with a frequency of 100 MHz. The radiation spectrum was recorded in the same way as in example 1. After the radiation of the argon in the lamp's appendage had been recorded, water was introduced and heated by means of the tungsten coil. The recorded spectra coincided with the spectra obtained in example 1.

EXAMPLE 3

Figure 3A:
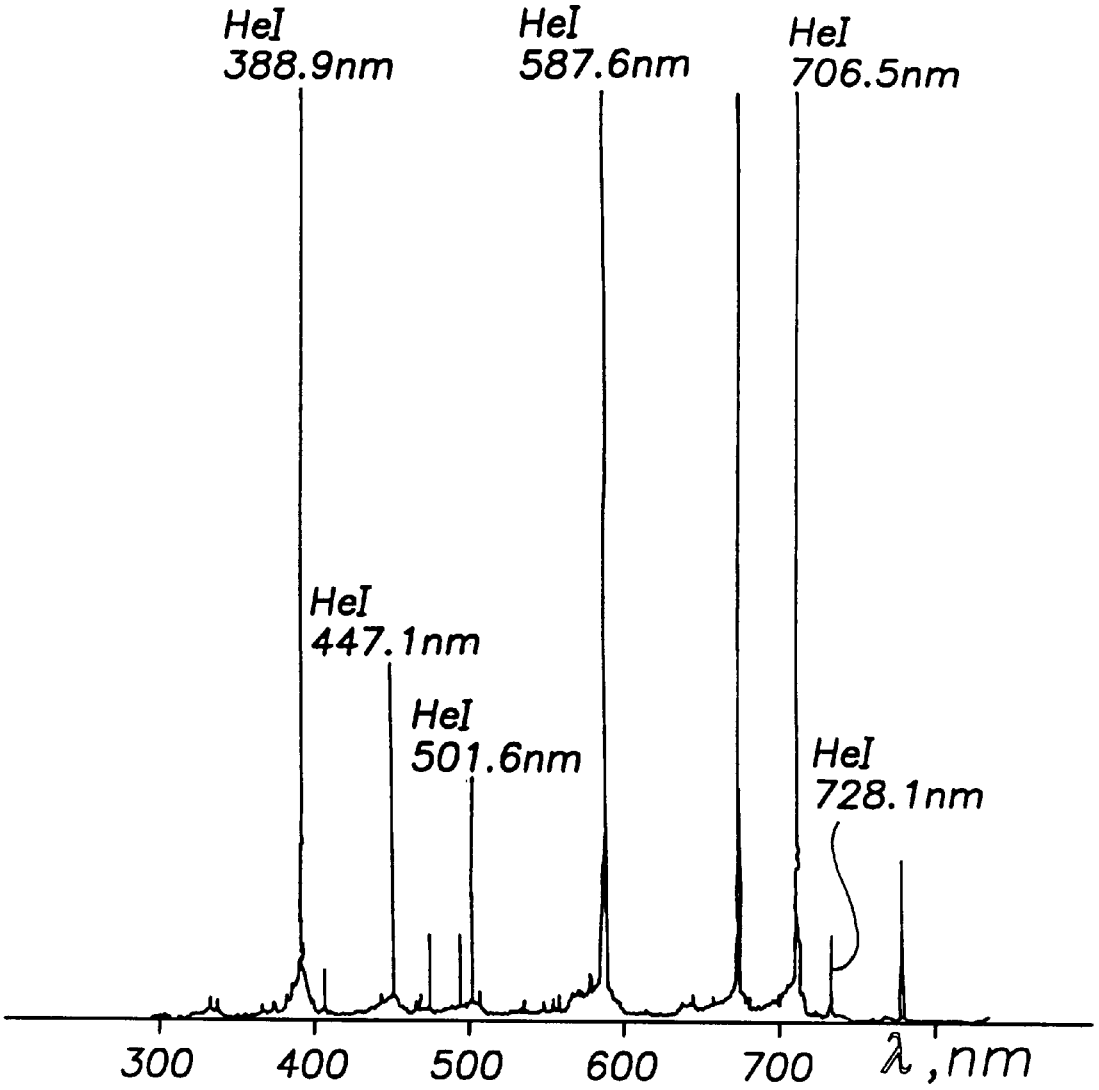
FIG. 3 shows the discharge lamp's radiation spectrum; a—lamp is filled with helium (at a pressure of 2660 Pa and discharge current 60 mA); b—a lamp is filled with helium (at a pressure of 2660 Pa and discharge current 60 mA) with addition of the HO radical obtained by discharge heating of calcium hydroxide.
Figure 3B:
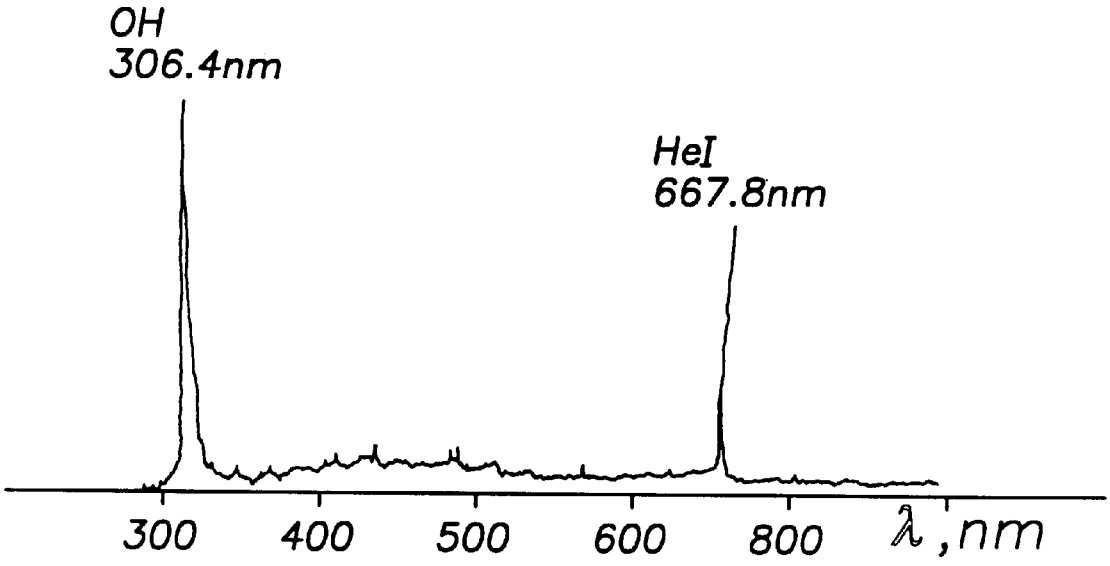

A non-electrode discharge lamp fabricated as in example 2 was filled with helium up to a pressure of 2660 Pa. The discharge lamp's radiation spectrum was recorded in the absence of HO radicals (FIG. 3(*a*)). The radiation spectrum represented the radiation of the helium atoms. Then magnesium alkali was placed in the lamp, discharge was activated and the lamp's radiation spectrum was recorded (cf. FIG. 3(*b*)). Comparison of the spectra in FIGS. 3(*a*) and 3(*b*) shows that radiation in the HO radical's band (306.4 nm) predominates.

EXAMPLE 4

A non-electrode lamp fabricated as in example 2 was filled with neon at a pressure of 288 Pa. The radiation spectra were recorded in the absence of HO radicals and after water had been added into the lamp. With HO radicals present in the discharge, the neon lines were virtually absent and all the radiation was found to be concentrated in the hydroxyl's 306.4 nm band.

Commercial applicability

The inventive method of producing optical radiation and the discharge lamp for that purpose may fine a use in industry and agriculture, in transport and for the lighting of populated areas and residences—everywhere where low-pressure discharge lamps of various types are currently used for lighting purposes.

What is claimed is:

1. Discharge lamp comprising a tube (1) of optically transparent material filled with an atmosphere consisting essentially of inert gas and radiating additive consisting of HO radicals, wherein an HO radical source is introduced to form the radiating additive, and further comprising means for maintaining a discharge in the atmosphere.

2. Discharge lamp as claimed in claim 1, characterized in that the HO radical source is introduced in a quantity of $10^{-11}$–$10^{-7}$ mol/cm$^3$.

3. Discharge lamp as claimed in claim 1, characterized in that as HO radical source, water is used.

4. Discharge lamp as claimed in claim 1, characterized in that as HO radical source, a substance containing the hydroxyl group is used.

5. Discharge lamp as claimed in claim 4, characterized in that as substance containing the hydroxyl group, a group II metal hydroxide is used.

6. Discharge lamp as claimed in claim 5, characterized in that as group II metal hydroxide, magnesium or calcium hydroxide is used.

* * * * *